US005704138A

United States Patent [19]

Donnadieu

[11] Patent Number: 5,704,138

[45] Date of Patent: Jan. 6, 1998

[54] MOUNTAIN HIKING BOOT WITH INTERNAL TIGHTENING DEVICE

[75] Inventor: Thierry Donnadieu, Le Vieux, France

[73] Assignee: Salomon S.A., Chavanod, France

[21] Appl. No.: 681,388

[22] Filed: Jul. 23, 1996

Related U.S. Application Data

[63] Continuation-in-part of Ser. No. 438,876, May 10, 1995, abandoned, which is a continuation of Ser. No. 161,066, Dec. 3, 1993, abandoned, which is a continuation of Ser. No. 908,461, Jul. 6, 1992, abandoned.

[30] Foreign Application Priority Data

Jul. 4, 1991 [FR] France ..... 91 08636

[51] Int. Cl.[6] ..... A43B 23/28; A43C 11/00

[52] U.S. Cl. ..... 36/58.5; 36/50.1

[58] Field of Search ..... 36/50.1, 58.5, 36/85, 117.6

[56] References Cited

U.S. PATENT DOCUMENTS

| | | | |
|---|---|---|---|
| 259,163 | 6/1882 | Johnson | 36/85 X |
| 1,216,579 | 2/1917 | Lemieux | 36/85 |
| 2,190,579 | 2/1940 | Wash | 36/50.1 X |
| 2,526,831 | 10/1950 | Schaeffler | 36/119 |
| 2,591,211 | 4/1952 | Spencer | 36/58.5 X |
| 3,052,045 | 9/1962 | Grimaldi | 36/58.5 X |
| 3,555,706 | 1/1971 | Edmonds | 36/114 |
| 3,768,182 | 10/1973 | Powers | 36/114 |
| 4,030,215 | 6/1977 | Vogel | 36/119 |
| 4,064,642 | 12/1977 | Vykukal et al. | 36/119 X |
| 4,342,161 | 8/1982 | Schmohl | 36/128 X |
| 4,476,639 | 10/1984 | Zaccaria | 36/50.1 X |
| 4,550,511 | 11/1985 | Gamm | 36/119 X |
| 4,562,654 | 1/1986 | Hue | 36/119 X |
| 4,638,578 | 1/1987 | Eiteljorg, II | 36/119 |
| 4,670,998 | 6/1987 | Pasternak | 36/50.1 X |
| 4,676,011 | 6/1987 | O'Rourke et al. | 36/89 |
| 4,693,021 | 9/1987 | Mazzarolo | 36/3 A X |
| 4,811,500 | 3/1989 | Maccano | 36/50.1 X |
| 4,813,158 | 3/1989 | Brown | 36/50.1 X |
| 5,154,011 | 10/1992 | Holzl | 36/119 X |
| 5,177,884 | 1/1993 | Rullier | 36/89 X |

FOREIGN PATENT DOCUMENTS

| | | |
|---|---|---|
| 2534459 | 4/1984 | France . |
| 2651414 | 3/1991 | France . |
| 3436670 | 4/1986 | Germany . |
| 4032826 | 5/1991 | Germany . |

*Primary Examiner*—Ted Kavanaugh
*Attorney, Agent, or Firm*—Pollock, Vande Sande & Priddy

[57] ABSTRACT

Sport shoe, in particular for mountain hiking, of the type comprising an outer sole (2) on which an external upper (3), open to the front to allow insertion of the foot (4) and capable of being closed over the latter by a closing system, is mounted. The shoe comprises an internal tightening device (8) designed to ensure position-retention of the foot (4) inside the shoe (1) and acting on the foot (4) independently of the external upper (3), which is designed to ensure protection of the foot (4).

5 Claims, 2 Drawing Sheets

MOUNTAIN HIKING BOOT WITH INTERNAL TIGHTENING DEVICE

CROSS-REFERENCE TO RELATED APPLICATION

This application is a Continuation-In-Part of U.S. patent application Ser. No. 08/438,876, filed May 10, 1995, now abandoned, which is a continuation of application Ser. No. 08/161,066 filed Dec. 3, 1993, now abandoned, which is a continuation of U.S. Ser. No. 07/908,461, filed Jul. 6, 1992, now abandoned.

FIELD OF THE INVENTION

The present invention relates to a sport shoe, in particular for mountain hiking, of the type comprising an outer sole on which an external upper open toward the front, to allow insertion of the foot, is conventionally mounted, this upper being capable of being closed over the foot by means of a closing system, e.g., a system which can be laced.

This upper ensures the external imperviousness of the shoe, in particular to rain or snow; it also provides for the mechanical protection of the foot against scree or other external threats, while ensuring position-retention of the ankle and protection of the latter against sprains, in particular on sloping or uneven terrain.

BACKGROUND OF THE INVENTION

To this end, some shoe models designed for high mountain wear incorporate an external upper made of a plastic material, so as to withstand the special conditions of glacier climbing.

To ensure the effective protection of the foot and ankle, and as regards the upper more specifically, these shoes are manufactured from very resistant materials, such as leather or even plastic, which is normally relatively thick and stiff.

Accordingly, a high level of traction must be exerted on the quarters of the upper themselves to permit tightening of the boot on the foot by means of a conventional lacing system.

Given the stiffness of the materials, it is difficult to determine the tightening force. This situation generally leads to excessive tightening, thereby producing painful spots, compression points, etc., which can cause extensive injury during long hikes or through repeated stages.

On the other hand, if the boot is insufficiently tightened, the foot moves or shifts inside the boot, generating friction between the foot and the boot, thereby causing blisters, or even burns.

When hiking, it has also been found that, while descending a slope, the foot tended to slide forward inside the boot, and, consequently, to produce contact under pressure of the foot against the tip of the boot caused by the shift of the wearer's weight toward this part, thereby producing localized fatigue and friction which compromise comfort.

Certain cross-country boots, e.g., those disclosed in FR 2 651 414, DE 4 032 826, and FR 2 534 459, incorporate a dual upper, i.e., an internal partial upper enclosing one part and comprising lacing-type tightening means, and an external upper, or appliqué, designed basically to protect the lacing means on the internal upper from cold, frost, and the penetration of snow or water.

In these boots, the requirements to be met are basically lightness and flexibility, so as to allow complete, unhindered extension of the foot and to ensure minimum weight, so that the problem underlying the present invention, i.e., reconciling good mechanical protection of the foot, i.e., protection against shocks, falling stones, sprains, etc., and simple, controlled tightening of the foot, does not arise in these boots and cannot be solved in them a posteriori.

Similarly, DE 3 436 670 discloses a sport shoe fitted on the inside with an arch-support system which in no way participates in tightening the foot in the boot, since an outer tightening system is provided, and which provides no indication or solution regarding the problem posed by the present invention.

SUMMARY OF THE INVENTION

The purpose of the present invention is to solve these problems by proposing a walking/mountain hiking boot sufficiently rigid to ensure foot protection, and allowing simultaneously controlled, simple, and easy tightening of the foot in the boot, with correct proportioning of the force exerted to effectively tighten the foot.

To this end, the invention consists in dissociating the foot-protection function which is still provided by an outer covering, in the present instance the external upper, from the foot-tightening function which is provided independently of the upper by an internal tightening device.

According to another invention feature, the internal tightening device is constituted by two tightening quarters, one inner and one outer, which function simultaneously in the instep area and are attached respectively by one of their lower ends to the inner and outer sides of the boot, their other free, upper ends being fitted with attachment and tightening means incorporated into them and arranged beneath the external upper.

It will be easily understood that, in this way, it is indeed much easier to proportion the tightening force, because, since the protective function is provided by the external upper, a much more flexible material can be used in the tightening quarters used to conform to the shape of the foot.

The tightening quarters are preferably arranged in the boot so as to enclose the instep, between the flection crease and the axis of articulation of the metatarsals.

Thus, the toes have a certain freedom of movement, thereby reducing problems related to blood circulation, numbness of the foot, and useless compression of some parts of the foot.

It has been found that:

- cramps are caused by excessively pronounced vertical compression on the instep, which squeezes the arch (stretching of muscle fibers);
- sensations of numbness and prickling are caused rather by blocking of blood or nerve circulation caused by an excessively-pronounced overall compression of the front part of the foot, or in the retro-malleolar space on either side of the Achilles tendon.

Furthermore, the freedom of the front part of the foot beyond the instep thus imparted facilitates the extension of the foot when walking.

The tightening quarters are advantageously made of a flexible perforated fabric, so as to ensure greater lightness of the boot, while offering ease of tightening and ventilation of the foot.

BRIEF DESCRIPTION OF THE DRAWINGS

The invention will be better understood and other inventive features will emerge from the following description provided with reference to the attached schematic drawings and illustrating, by way of example, one preferred embodiment.

DESCRIPTION OF THE PREFERRED EMBODIMENT

Figure 1:
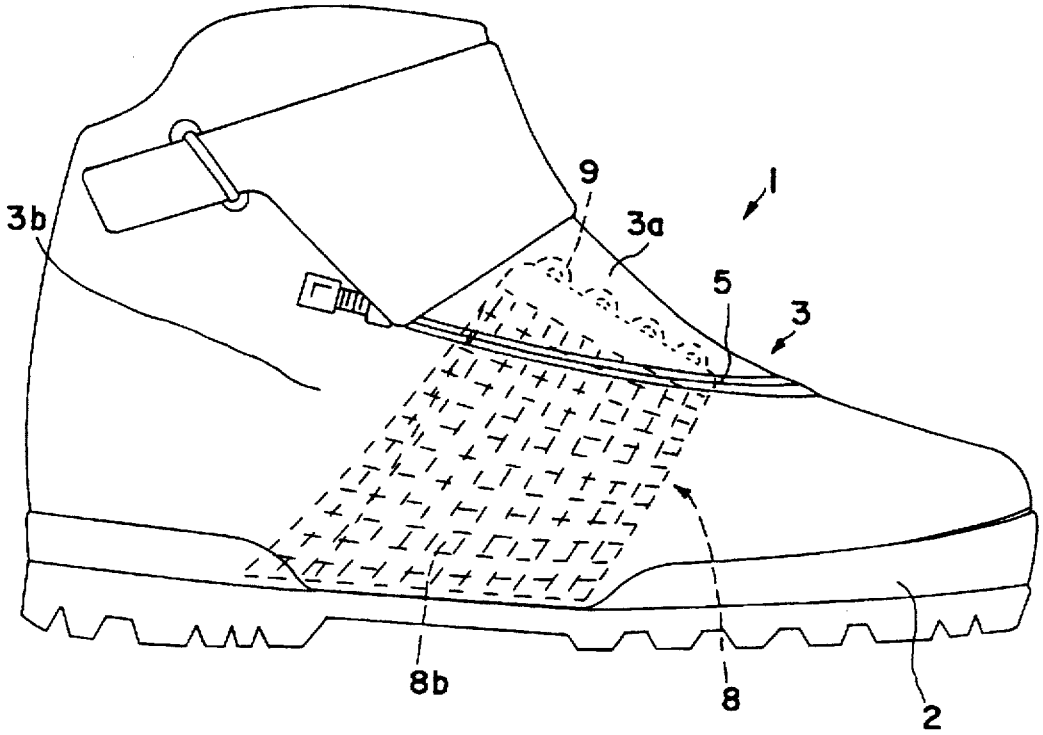
FIG. 1 is a lateral view of a mountain boot according to the invention.

FIG. 1 represents a mountain boot 1 of the type comprising an outer sole 2 on which an external upper 3, open to the front to allow insertion of the foot 4, is mounted. The upper 3 is here constituted by two half-appliqués, an internal appliqué 3*a* located on the inner side of the foot 4, and an external appliqué 3*b* located on the outer side of the foot 4, these two half-appliqués 3*a* and 3*b* being connected by a closing system 5, e.g., a zipper or self-gripping means.

Figure 2:
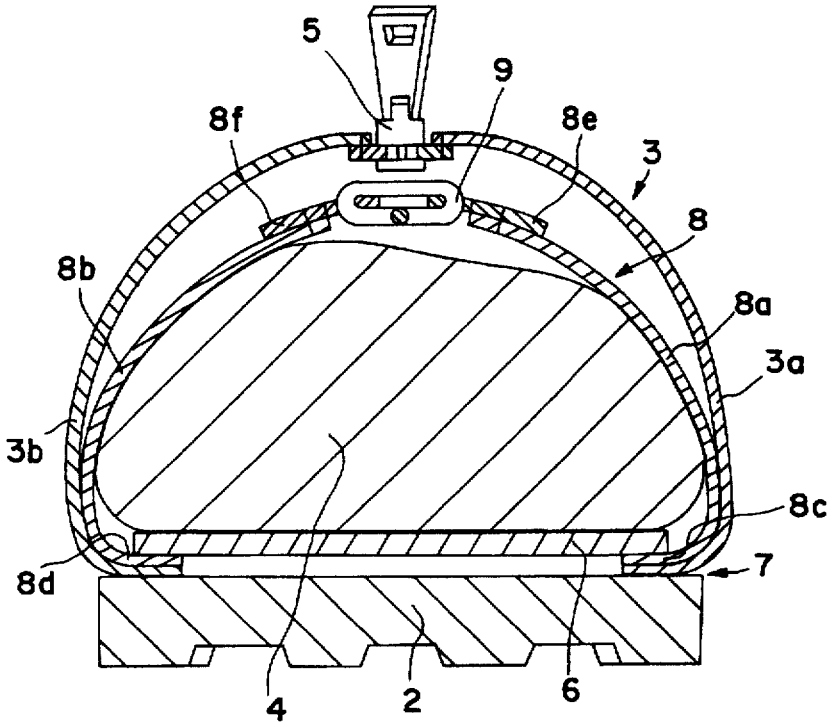
FIG. 2 is a schematic transverse cross-section of the boot in FIG. 1.

FIG. 2 reveals that each of the half-appliqués 3*a*, 3*b* belonging to the upper 3 is bonded to the sole 2 simultaneously with the insole 6 in an area of assembly, termed an assembly connection 7, which is positioned between the sole 2 and the insole 6.

According to the invention, the mountain boot 1 comprises an internal tightening device 8 designed to ensure position-retention of the foot 4 within the boot 1, this device acting on the foot 4 independently of the upper 3, which is designed to provide mechanical protection of the foot 4.

The internal tightening device 8 is constituted by internal and external tightening quarters 8*a* and 8*b*, which function simultaneously in the wearer's instep area, these quarters being attached by their lower ends 8*c*, 8*d*, respectively, to the inner and outer sides of the boot 1. The other, upper free ends 8*e* and 8*f*, respectively, are fitted with attachment and tightening means 9 incorporated in them and arranged beneath the upper 3 when the latter is closed using its closing system 5.

The two tightening quarters 8*a*, 8*b* make it possible to press the wearer's foot 4 against cleanliness insole (not shown) placed on the insole 6, on which the sole 2 is bonded after simultaneous interposition and bonding of the lower ends 8*c*, 8*d* of the tightening quarters 8*a*, 8*b* and of the half-appliqués 3*a*, 3*b* of the upper 3.

Rather than using a bonding operation, the tightening quarters 8*a*, 8*b* may be mounted by their lower ends 8*c*, 8*d* directly on the half-appliqués 3*a*, 3*b* belonging to the upper 3 by means of an associated seam (not shown) located above the assembly connection 7 in the upper 3. In this case, the quarters 8*a*, 8*b* are shorter.

Figure 3:
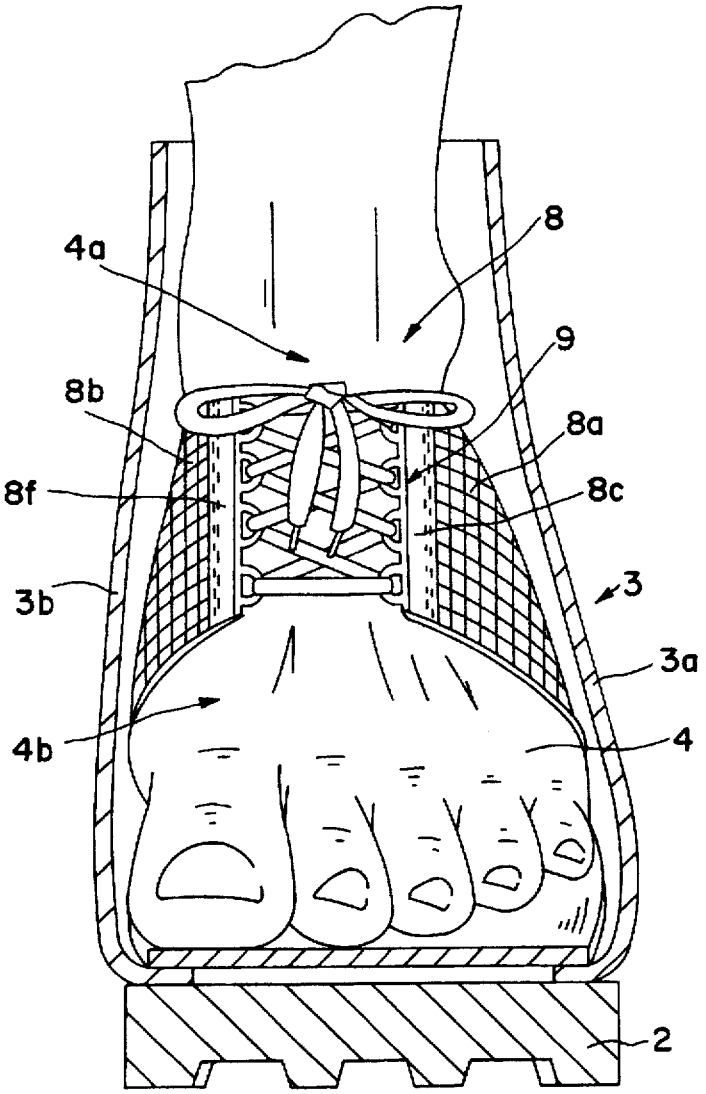
FIG. 3 is a frontal, partially cut-away view of the boot showing the position of the foot in the boot when it is held by the device according to the invention.

As shown in FIGS. 1 and 3, the tightening quarters 8*a*, 8*b* are positioned in the vicinity of the instep, between the flection crease 4*a* of the foot 4 and the axis of articulation of the metatarsals 4*b*.

The tightening quarters 8*a*, 8*b* belonging to the device 8 are preferably manufactured from a flexible material, such as a perforated fabric or a netting having the aforementioned advantages.

Furthermore, the attachment and tightening means 9 on the free upper ends 8*e*, 8*f* of the tightening quarters 8*a*, 8*b* are constituted by a lacing system. Alternatively, they could be replaced by self-gripping strips or any other conventional tightening means.

What is claimed is:

1. Mountain hiking boot (1) comprising:

(a) an outer sole (2) sufficiently flexible to allow at least partial unrolling of a foot of a wearer of said boot;

(b) an external upper (3) made of a material which is sufficiently rigid to assure mechanical protection of a foot but sufficiently flexible to allow partial unrolling of said foot, said upper having an open front allowing insertion of said foot (4), and comprising a closing system (5) for closure of said boot;

(c) an internal tightening device (8) disposed inside said upper (3) and being constituted by two internal quarters (8*a*, 8*b*) having lower ends (8*c*, 8*d*) attached to a side of said boot, each of said internal quarters (8*a*, 8*b*) being made of flexible material and being arranged only in an instep area approximately between a flexion crease (4*a*) of said foot (4) and an articulation axis of metatarsals (4*b*) of said foot, and each of said internal quarters having an upper free end portion which is spaced from and unconnected with said external upper, said tightening device being adapted to immobilize said foot against all horizontal movement in a longitudinal axial direction of said boot; and (d) said upper free end portion (8*e*, 8*f*) of each internal quarter (8*a*, 8*b*) being fitted with attachment and tightening means incorporated therein and arranged beneath said external upper, whereby said internal quarters ensure positioning and tightening of said foot (4) inside said boot (1) independently of said external upper;

(e) said mechanical protection of said foot provided by said external upper (3) being dissociated from and independent of said foot tightening provided by said internal tightening device, respectively.

2. Mountain hiking boot according to claim 1, wherein said flexible material of which said tightening quarters (8*a*, 8*b*) are made is a netting.

3. Mountain hiking boot according to claim 1, said flexible material of which said tightening quarters (8*a*, 8*b*) are made is perforated.

4. Mountain hiking boot according to claim 1, wherein said tightening means (9) on said free ends (8*e*, 8*f*) of said tightening quarters (8*a*, 8*b*) are constituted by a lacing system.

5. Mountain hiking boot according to claim 1, wherein assembly of said tightening quarters (8*a*, 8*b*) is effected by a lacing system.

* * * * *